US007001064B2

(12) United States Patent
Finazzi

(10) Patent No.: US 7,001,064 B2
(45) Date of Patent: Feb. 21, 2006

(54) PUSH-PIECE CONTROL DEVICE FOR A WATCH

(76) Inventor: Pierre-André Finazzi, Rue du Commerce 17, 2300 La Chaux-de-Fonds (CH)

( * ) Notice: Subject to any disclaimer, the term of this patent is extended or adjusted under 35 U.S.C. 154(b) by 339 days.

(21) Appl. No.: 10/276,557

(22) PCT Filed: May 10, 2001

(86) PCT No.: PCT/CH01/00289

§ 371 (c)(1),
(2), (4) Date: Apr. 14, 2003

(87) PCT Pub. No.: WO01/88633

PCT Pub. Date: Nov. 22, 2001

(65) Prior Publication Data

US 2004/0100869 A1 May 27, 2004

(30) Foreign Application Priority Data

May 18, 2000 (CH) ..... 998/00

(51) Int. Cl.
*G04B 3/04* (2006.01)

*G04B 37/06* (2006.01)

(52) U.S. Cl. ..... 368/319; 368/216

(58) Field of Classification Search ..... 368/286–290, 368/308, 319, 216
See application file for complete search history.

(56) References Cited

U.S. PATENT DOCUMENTS

| | | | | |
|---|---|---|---|---|
| 3,759,033 | A | 9/1973 | Jeanmonod | |
| 6,200,019 | B1 * | 3/2001 | Latini | 368/289 |
| 6,210,034 | B1 * | 4/2001 | Latini | 368/289 |
| 6,679,624 | B1 * | 1/2004 | Mouawad | 368/216 |
| 2004/0105346 | A1 * | 6/2004 | Lang | 368/80 |

FOREIGN PATENT DOCUMENTS

| | | |
|---|---|---|
| CH | 226715 | 4/1943 |
| CH | 13 865/75 | 7/1977 |
| EP | 0 443 087 | 8/1991 |

* cited by examiner

*Primary Examiner*—Kamand Cuneo
*Assistant Examiner*—Jeanne-Marguerite Goodwin
(74) *Attorney, Agent, or Firm*—Young & Thompson

(57) ABSTRACT

The invention concerns a push-piece control device for a watch comprising a case (10) provided with a middle (12), an arbor (16) integral with a crown (20) and mounted pivoting in the middle (12) and a push-piece (18) mounted sliding and coaxial to the arbor (16). The invention is characterized in that it further comprises a lever (32) mounted pivoting on said case (10) by one of its ends (32*a*), mobile in a plane substantially parallel to the watch plane, including, in its median part (32*b*), a contact point designed to co-operate with said push-piece (18) and, at its other end (32*c*), a concave control portion.

18 Claims, 3 Drawing Sheets

PUSH-PIECE CONTROL DEVICE FOR A WATCH

BACKGROUND OF THE INVENTION

Figure 1:
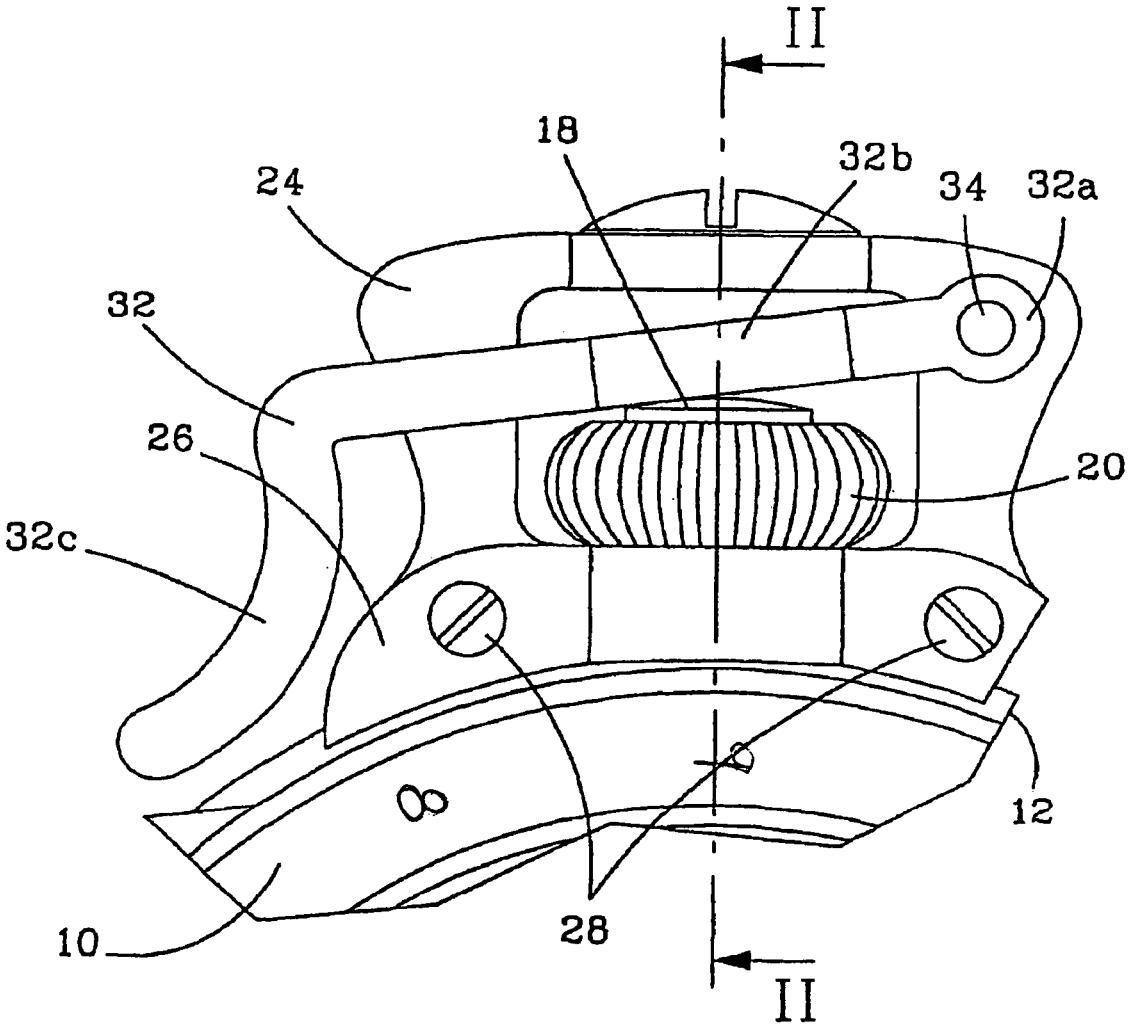

The present invention relates to push-piece control devices for watches provided with a crown for setting the time and, when they include a mechanical power source, for winding the main spring of the barrel. More precisely, the invention concerns watches including a push-piece coaxial with the crown. Such watches are, for example, disclosed and shown in the work entitled "Le Chronographe", B. Humbert, Scriptar S A, Lausanne 1955. They are usually chronographs or counters.

Within the scope of the present description, the positions of the various components disposed on the periphery of the watch are defined with reference to the position that an hour hand would occupy at a given time.

The fact of placing the push-piece concentrically to the crown, as proposed in Swiss Patent document No. 226715 simplifies the structure of the case and can give the watch a particular look. In most cases the crown is at 3 o'clock. This position is ergonomically favorable for winding and setting the time of the watch. However, applying pressure to a push-piece occupying this position requires unnatural movements. The object of the present invention is to overcome this drawback.

The device of the invention is thus characterized in that it further includes a lever mounted so as to pivot on said case via one of its ends, mobile in a substantially parallel plane to the plane of the watch, including, in its median part, a contact point intended to co-operate with the push-piece and, at its other end, a control portion, of concave shape.

SUMMARY OF THE INVENTION

The combination of a lever with a push-piece is also known, particularly from Patent document Nos. U.S. Pat. No. 3,759,033, EP 0443087 or CH 13865/75, which disclose chronographs or counters wherein the push-pieces are integrated in the case.

In order for the device to fully fulfill its function, the lever must be securely fixed to the case and disposed so as to avoid any inadvertent actuation. This is why, in a first embodiment, the push-piece includes a button partially engaged in the crown and forming a protruding portion. The case further includes a stirrup-shaped piece straddling the crown and the push-piece. This stirrup-shaped piece is fixed by its two ends to the middle part. The lever is mounted so as to pivot on the stirrup-shaped piece, and extends between the straddling portion and the push-piece, then beyond the stirrup-shaped piece to form the control portion.

Advantageously, the case includes a tube in which the push-piece and the stem are arranged, whereas the stirrup-shaped piece is provided with a clamp fixed to its two ends and surrounding and gripping the tube.

According to a second embodiment, also allowing the lever to be securely fixed to the case and any inadvertent maneuver to be avoided, the push-piece includes an annular portion inserted between the crown and the middle part and the lever is inserted between this annular portion and the crown.

In order to assure secure and reliable fixing, the middle part is provided with a stud onto which the lever is mounted so as to pivot.

Such solutions are particularly advantageous when the crown is at 9 o'clock and the control portion is at approximately 8 o'clock, as the protruding elements are in a well protected part, since they are placed on the elbow side. Consequently, the risk of catching on something is substantially reduced.

Figure 2:
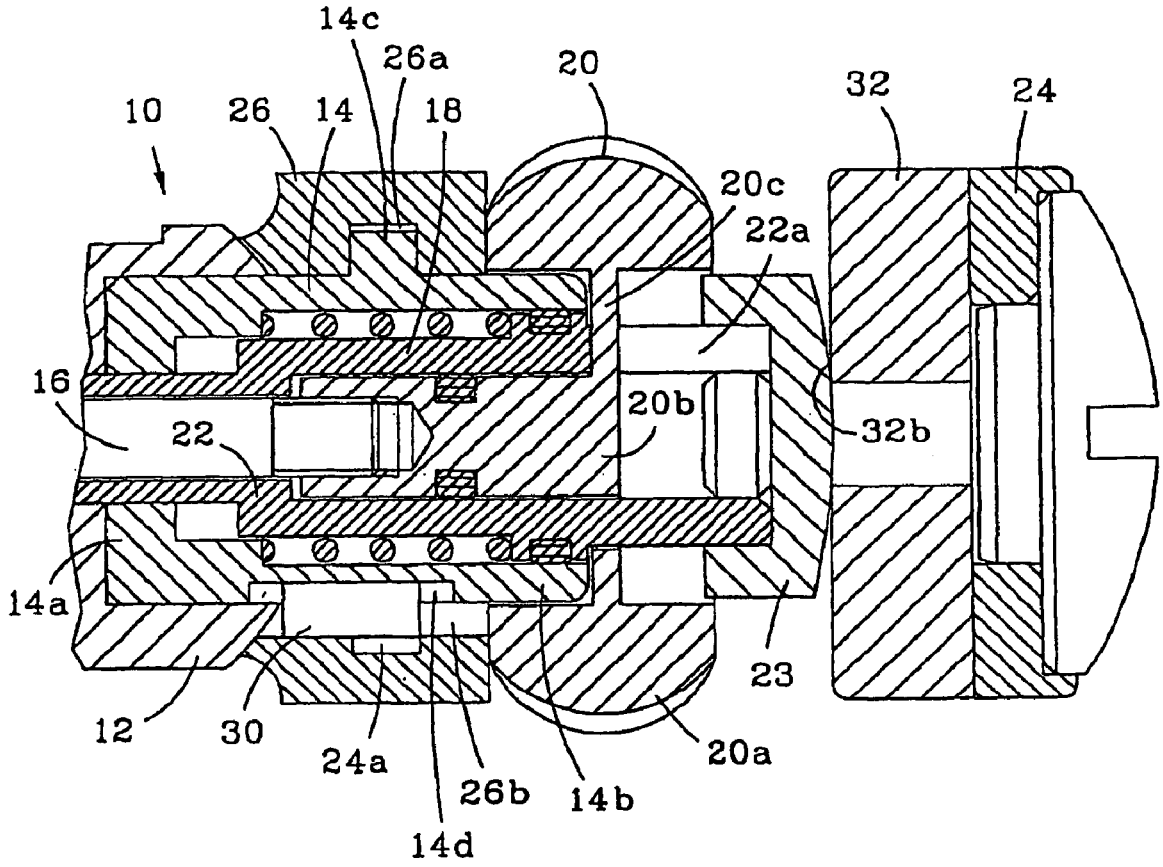
Figure 3:
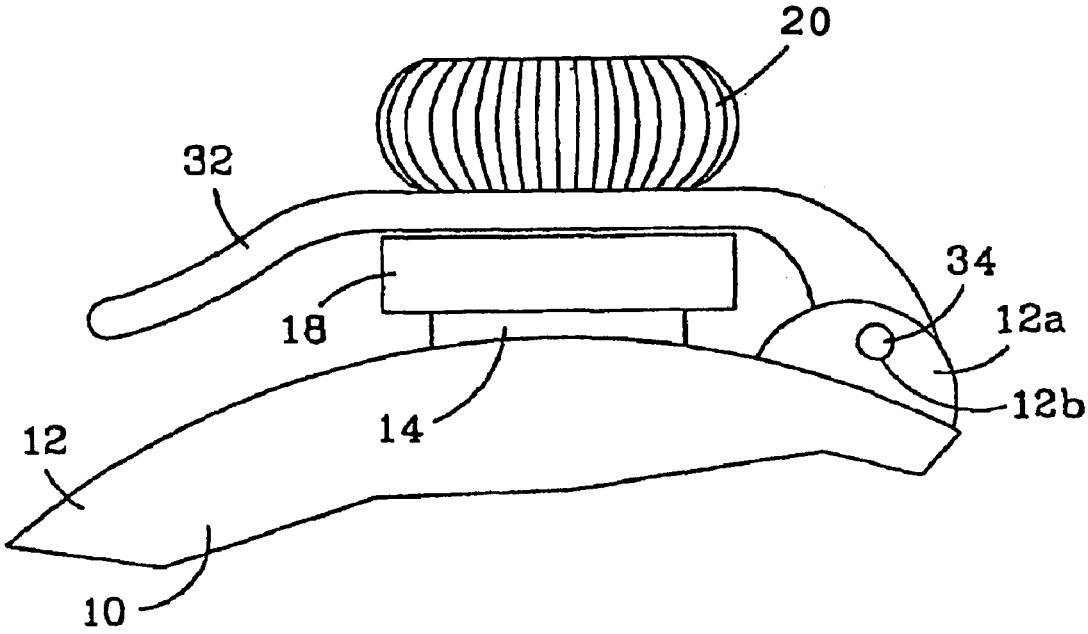
Figure 4:
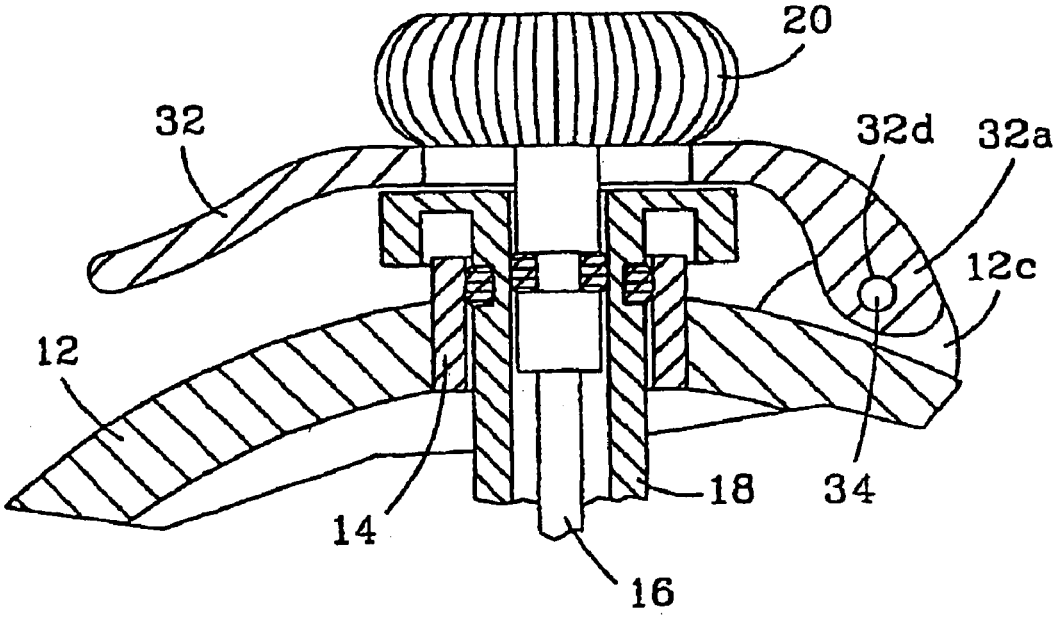

Other features and advantages of the invention will appear from the following description, made with reference to the annexed drawing, in which:

FIGS. 1 and 2 show a control device according to a first embodiment of the invention, seen respectively from above and in cross-section along the line II—II of FIG. 1, and FIGS. 3 and 4 show a device according to a second embodiment, seen from above in plane and cross-sectional views.

BRIEF DESCRIPTION OF THE INVENTION

FIGS. 1 and 2 show a watch portion including a case 10 including notably a middle part 12 and a tube 14 driven into a hole in the middle part. A watch movement, not shown in the drawing, is housed in case 10. It is of the chronograph type, controlled by a stem 16 and a push-piece 18.

Tube 14 is formed of a first portion 14*a*, engaged in middle part 12, and a second portion 14*b* extending outside the middle part. Second portion 14*b* includes an annular flange 14*c* and a groove 14*d* whose orientation is parallel to the axis of the tube.

Stem 16 carries, at its external end, a crown 20 for setting the time and, in the case of a mechanical watch, for rewinding the power source. Crown 20 includes a first external part 20*a* of annular shape, a second part 20*b*, forming a hub secured to stem 16 and a third intermediate part, formed of three radially oriented spokes 20*c* connecting hub 20*b* to part 20*a*.

DESCRIPTION OF THE PREFERRED EMBODIMENTS

Push-piece 18 includes a tubular part 22 and a cap 23 secured to the, end of part 22 to close the hole located outside case 10. Tubular part 22 is provided, in its portion in proximity to cap 23, with three grooves 22*a* extending over the whole of its part disposed outside tube 14, in which spokes 20*c* are engaged. It should be noted that the axial distance from hub 20*b* and spokes 20*c* to cap 23 is of the order of approximately 1 mm. Consequently, it is possible to assure a sufficient movement of the push-piece to control the mechanism with which it is associated and of the crown during the time setting function.

Cap 23 projects from crown 20 to form a button intended to apply pressure to control a function of the watch.

A stirrup-shaped piece 24, forming a loop around crown 16 and push-piece 18, is fixed onto tube 14 by a clamp 26, secured to stirrup-shaped piece 24 by screws 28. More precisely, stirrup-shaped piece 24 and clamp 26 include an annular groove identified by the letter a in which flange 14*a* is engaged, which axially blocks stirrup-shaped piece 24. A hollow 26*b* is made in clamp 26, parallel to groove 14*d*, of the same width and the same length. A key 30 is disposed in the housing formed by groove 14*d* and hollow 26*b*, thus blocking the stirrup-shaped piece in rotation.

Stirrup-shaped piece 24 carries a lever 32, mounted so as to pivot via one of its ends 32*a* by means of a pin 34 engaged in holes in lever 32 and stirrup-shaped piece 24. Lever 32 is mobile in a substantially parallel plane to the plane of the watch, which is defined by the surface of its dial.

Lever 32 includes, in its median part 32*b*, a contact point for co-operating with push-piece 18, by abutting cap 23. The other end 32*c* constitutes a control portion, of concave shape.

The control device further includes a spring for returning push piece 14 and sealing gaskets to prevent water penetrating the movement. These parts will not be described in more detail, since they do not form part of the invention.

The device described allows the following functions to be fulfilled.

When the device is in the position shown in the drawing, the application of a torque on crown 20 has the effect of rotating stem 16, which winds the power source of the watch if it is a mechanical timepiece. This rotational movement also causes push-piece 18 to rotate, without any consequences.

In order to set the time of the watch, one need only pull out crown 20. This is possible, because of the play comprised between parts 20*b* and 20*c* of crown 20 and cap 23. By then rotating crown 20, the position of the hands is corrected, owing to a well known mechanism associated with the watch movement.

Push-piece 18 allows a complementary function to be controlled, for example a chronograph, a first application of pressure causing the chronograph mechanism to start, a second causing it to stop and a third resetting the hands to zero. In order to control these functions, one need only press on end 32*c* of lever 32 with a finger. It should be noted that the concave shape of this end allows the finger responsible for applying pressure to be well positioned.

The presence of this lever 32 means that the force to be applied to control the push-piece is not oriented along the axis of the push-piece. This dislocation is advantageous. Indeed, the timesetting crown is generally located at 3 o'clock, which corresponds to the most favorable position for rewinding the watch. This offset is, however, inconvenient for applying pressure. Further, since the push-piece projects from the crown, there is a risk of it becoming caught.

This risk is removed by placing the crown at 9 o'clock. Moreover, the presence of the lever allows the orientation of the force to be applied to be shifted along the 8 o'clock-2 o'clock direction, which is much more favorable.

In the embodiment of the device shown in FIGS. 3 and 4, one can again see case 10, middle part 12, tube 14, stem 16, push-piece 18, crown 20 and lever 32. In this configuration, crown 20 is on the outside, whereas push-piece 18, inserted between tube 14 and stem 16, is of annular shape and stops, axially, beyond tube 14, but leaving, between it and the crown, a space in which lever 32 is housed.

Middle part 12 includes a stud 12*a* provided with a hole 12*b* and a slot 12*c*. End 32*a* of lever 32, pierced with a hole 32*d*, is slipped into slot 12*c* and mounted so as to pivot on the stud by means of a pin 34 forcibly engaged in one or other of holes 12*b* and 32*d*.

This second embodiment allows the push-piece to be placed in a position that is normally inaccessible to pressure from a finger, while considerably simplifying the structure of the assembly, and more particularly of the crown and the push-piece. Moreover, it is no longer necessary to have a stirrup-shaped piece to hold the lever, the latter being held by the crown.

The invention claimed is:

1. Push-piece control device for a watch of the type comprising a case (10) provided with a case frame (12), a stem (16) secured to a crown (20) and pivotally mounted in the case frame (12) and a push-piece (18) slidably mounted coaxially of the stem (16), characterized in that it moreover comprises a lever (32) pivotally mounted on said case (10) at one of its ends (32*a*), movable in a plane substantially parallel to the plane of the watch, comprising in its medial portion (32*b*), a point of contact adapted to coact with said push-piece (18) and at its other end (32*c*) a control portion of concave shape.

2. Device according to claim 1, characterized in that said push-piece forms, with its outer end, a protuberant button (23) partially engaged in the crown (20), in that the case (10) comprises, in addition, a stirrup (24) overlapping the crown (20) and the push-piece (18) and fixed by its two ends to the case frame (12) and in that the lever (32) is pivotally mounted on said stirrup (24), and extends between the overlapping portion and the button (23), then beyond the stirrup (24) to form said control portion (32*c*).

3. Device according to claim 2 characterized in that the crown (20) and the push-piece (18) are disposed at 9:00 and the control portion (32*c*) in a region comprised between 7 and 8:00.

4. Device according to claim 2, characterized in that the case (10) comprises a tube (14) in which are disposed the push-piece (18) and the stem (16), and in that said stirrup (32) is provided with a stay (26) fixed at its two ends and enclosing said tube (14).

5. Device according to claim 4 characterized in that the crown (20) and the pushpiece (18) are disposed at 9:00 and the control portion (32*c*) in a region comprised between 7 and 8:00.

6. Device according to claim 1, characterized in that said push-piece (18) is formed by a tube surrounding said stem (16) and of which one end is disposed within the case and a second end is located between the crown and the case frame and in that said lever (32) is interposed between said second end and said crown (20).

7. Device according to claim 6 characterized in that the crown (20) and the push-piece (18) are disposed at 9:00 and the control portion (32*c*) in a region comprised between 7 and 8:00.

8. Device according to claim 6, characterized in that said case frame (12) is provided with a lug (12*a*) on which said lever (32) is pivotally mounted.

9. Device according to claim 8 characterized in that the crown (20) and the push-piece (18) are disposed at 9:00 and the control portion (32*c*) in a region comprised between 7 and 8:00.

10. Device according to claim 1 characterized in that the crown (20) and the push-piece (18) are disposed at 9:00 and the control portion (32*c*) in a region comprised between 7 and 8:00.

11. Device according to claim 1, wherein, the crown and push-piece are each configured for independently controlling different functions of a watch movement.

12. Push-piece control device for a watch, comprising:

a crown (20);

a stem (16) pivotally mounted to a case frame (12) and, at an outer end, carrying the crown (20);

a push-piece (18) slidably mounted coaxially around the stem (16); and a lever (32), movable in a plane substantially parallel to a plane of the watch, comprising a first end (32*a*) pivotally mounted on the case (10) at a second end (32*c*), a control portion of concave shape, in a medial portion (32b) intermediate the first end and the second end, a point of contact adapted to coact with the push-piece (18).

13. The device of claim 12, wherein, the crown and pushpiece are each configured for independently controlling different functions of a watch movement.

14. The device of claim 12, wherein, the push-piece (18) comprises a tubular piece (22), slidably mounted coaxially around the stem (16), and a plug (23) at an end of the tubular piece, and the point of contact of the lever is adapted to coact with the push-piece by bearing against an exterior surface of the plug.

15. The device of claim 14, wherein, the plug (23) extends beyond the crown (20) to form a button adapted to apply pressure to control a function of the watch.

16. The device of claim 15, wherein, pressure applied to the control portion of the lever is transmitted to the push-piece as an offset force applied to control the push-piece oriented along a nonaxis of the push-piece.

17. The device of claim 12, wherein, the push-piece is adapted to control starting and stopping a mechanism through a first pressure starting the mechanism and a second pressure stopping the mechanism, the pressures applied to the push-piece through the control portion of the lever.

18. The device of claim 12, wherein, the push-piece is adapted to perform starting and stopping control applied to the push-piece through the control portion of the lever.

* * * * *